US006513288B1

(12) United States Patent
MacDonald et al.

(10) Patent No.: US 6,513,288 B1
(45) Date of Patent: Feb. 4, 2003

(54) WINDOW ASSEMBLY FOR PARTITIONS

(75) Inventors: Douglas B. MacDonald, Caledonia, MI (US); Theodore Q. Chau, Grand Rapids, MI (US); Kevin J. Longhurst, Hastings, MI (US); Richard S. Hand, Holland, MI (US); Mark D. Porter, Caledonia, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/258,384

(22) Filed: Feb. 26, 1999

(51) Int. Cl.[7] ..... E04H 1/06

(52) U.S. Cl. ..... 52/239; 52/36.1; 52/28; 160/137; 160/225

(58) Field of Search ..... 52/238.1, 239, 52/64, 67, 240, 241; 160/137, 152, 159, 222, 225, 372; 58/36.1

(56) References Cited

U.S. PATENT DOCUMENTS

| | | | | |
|---|---|---|---|---|
| 2,831,553 A | | 4/1958 | Pollock | |
| 3,006,041 A | | 10/1961 | Thuet et al. | |
| 3,040,847 A | | 6/1962 | Webster | |
| 3,081,504 A | | 3/1963 | Bohsack | |
| 3,125,191 A | | 3/1964 | Singer et al. | |
| 3,323,262 A | | 6/1967 | Di Cesare, Jr. et al. | |
| 3,423,897 A | | 1/1969 | Birum, Jr. | |
| 3,478,478 A | | 11/1969 | Luebs | |
| 3,490,178 A | | 1/1970 | Voisin | |
| 3,750,358 A | | 8/1973 | Lewkowitz | |
| 3,881,287 A | | 5/1975 | Biebuyck | |
| 3,916,595 A | | 11/1975 | Biebuyck | |
| 3,961,452 A | | 6/1976 | Hubbard et al. | |
| 4,434,596 A | * | 3/1984 | McAteer et al. | 52/243.1 |
| 4,450,658 A | * | 5/1984 | Legeai | 52/126.3 |
| 4,897,975 A | | 2/1990 | Artwick et al. | |
| 5,038,539 A | | 8/1991 | Kelley et al. | |
| 5,069,263 A | * | 12/1991 | Edwards | 160/135 |
| 5,088,250 A | | 2/1992 | DeLong et al. | |
| 5,155,955 A | | 10/1992 | Ball et al. | |
| 5,218,799 A | | 6/1993 | Appino | |
| 5,433,046 A | * | 7/1995 | MacQuarrie et al. | 52/238.1 |
| 5,546,718 A | * | 8/1996 | Way | 52/238.1 |
| 5,560,155 A | | 10/1996 | Back | |
| 5,642,593 A | * | 7/1997 | Shieh | 52/239 |
| 5,713,167 A | | 2/1998 | Durham et al. | |
| 5,918,422 A | * | 7/1999 | Bucher, Jr. | 52/36.5 |
| 5,934,020 A | * | 8/1999 | McCracken | 49/56 |

* cited by examiner

*Primary Examiner*—Yvonne M. Horton
(74) *Attorney, Agent, or Firm*—Price, Heneveld, Cooper, DeWitt & Litton

(57) ABSTRACT

A window assembly for installation across at least a portion of an opening through a partition frame. The window assembly includes a sheet of light-transmitting material defining opposite edges. Side members are disposed on the opposite side edges, and telescope relative to one another. At least one of the side members includes a connector for securing the window assembly to the partition frame. The connector engages the partition frame upon telescoping of the side members to secure the window to the partition frame.

34 Claims, 8 Drawing Sheets

WINDOW ASSEMBLY FOR PARTITIONS

CROSS-REFERENCES TO RELATED APPLICATIONS

The present application is related to commonly assigned, U.S. patent application Ser. No. 09/060,911, filed Apr. 15, 1998, entitled MODULAR WINDOW, Now issued U.S. Pat. No. 6,058,667, and is also related to commonly assigned, U.S. patent application Ser. No. 08/914,664, filed Aug. 19, 1997, entitled KNOCK-DOWN PORTABLE PARTITION SYSTEM, now issued U.S. Pat. No. 6,009,675, and commonly assigned, U.S. patent application Ser. No. 08/856,995, filed May 15, 1997, entitled KNOCK-DOWN PORTABLE PARTITION SYSTEM, now issued U.S. Pat. No. 5,899,035, and commonly assigned, U.S. patent application Ser. No. 09/060,913, filed Apr. 15, 1998, entitled KNOCK-DOWN PORTABLE PARTITION SYSTEM, now issued U.S. Pat. No. 6,098,358, all of which are incorporated by reference.

BACKGROUND OF THE INVENTION

The present invention relates to a window assembly for partition panels and the like, and in particular to a fastenerless window module that is quickly and easily assembled and installed on site without the use of tools.

Open office plans have been developed to reduce overall officing cost, and generally incorporate large, open floor spaces in buildings that are equipped with modular furniture systems which are readily reconfigurable to accommodate the ever changing needs of a specific user, as well as the divergent requirements of different tenants. One arrangement commonly used for furnishing open plans includes movable partition panels that are detachably interconnected to partition off the open spaces into individual workstations and/or offices. Such partition panels are configured to receive hang-on furniture units, such as work surfaces, overhead cabinets, shelves, etc., and are generally known in the office furniture industry as "systems furniture". Another arrangement for dividing and/or partitioning open plans includes modular furniture arrangements, in which a plurality of differently shaped, free standing furniture units are positioned in a side-by-side relationship, with upstanding privacy screens attached to at least some of the furniture units to create individual, distinct workstations and/or offices. Both of these types of modular furniture systems, as well as others, have been widely received due largely to their ability to be readily reconfigured and/or moved to a new site, since they are not part of a permanent lease hold improvement.

One type of partition panel utilizes prefabricated panels having generally rectangular perimeter frames that are interconnected along vertical side edges to form a partition wall. Such systems have redundant vertical structure along the side edges, resulting in increased costs. Furthermore, due to the size and weight of the prefabricated panels, wider and/or higher panels may be difficult to transport and handle at the installation site. Due to the excessive weight and size of a large prefabricated panel, the width and/or height of prefabricated panels are limited. Because smaller prefabricated panels must be used, additional vertical structure and connections are required along a given partition wall due to the greater number of prefabricated panels. Due to these limitations of prefabricated panels, knockdown panel frames that can be transported in individual pieces and assembled on site have been developed. This arrangement allows very wide and/or high panels to be used, thereby reducing the number of cover panels, frame members, and connectors required.

Prefabricated window panels that are compatible with prefabricated panel systems have been developed. However, prefabricated window panels suffer from many of the same disadvantages as other types of prefabricated panels, including excessive shipping costs and other related expenses.

SUMMARY OF THE INVENTION

One aspect of the present invention is a window assembly for installation across at least a portion of an opening through a partition frame. The window assembly includes a sheet of light-transmitting material defining opposite edges. Side members are disposed on the opposite side edges, and telescope relative to one another. At least one of the side members includes a connector for securing the window assembly to the partition frame. The connector engages the partition frame upon telescoping of the side members, and thereby secures the window to the partition frame.

Another aspect of the present invention is a combination knockdown partition frame and window assembly. The knockdown partition frame includes a pair of horizontally spaced-apart vertical posts, and a pair of vertically space-apart horizontal beams extending therebetween. The horizontal beams have opposite ends releasably interconnecting the post to define therewith a partition frame having an enlarged opening therethrough. The window assembly includes a light-transmitting sheet and a pair of edge members that are positioned on opposite edges of the sheet. The edge members are movable relative to one another between an engaged position and a disengaged position. At least a first one of the side edge members includes a connector that engages the partition frame upon movement to the engaged position to thereby connect the window assembly to the partition frame.

Yet another aspect of the present invention is a method of securing a window assembly to a frame. The method includes providing a light-transmitting sheet having opposite side edges. At least one side member is placed on a selected one of the side edges of the sheet in a movable relationship thereto to form a window assembly. The light-transmitting sheet is placed across at least a portion of an opening through the frame, and the side member is interconnected with the frame by shifting the side member relative to the sheet and into engagement with the frame to thereby interconnect the side member and the frame.

These and other advantages of the invention will be further understood and appreciated by those skilled in the art by reference to the following written specification, claims, and appended drawings.

BRIEF DESCRIPTION OF THE DRAWINGS

FIG. 3;

FIG. 3;

DETAILED DESCRIPTION OF PREFERRED EMBODIMENT

Figure 1:
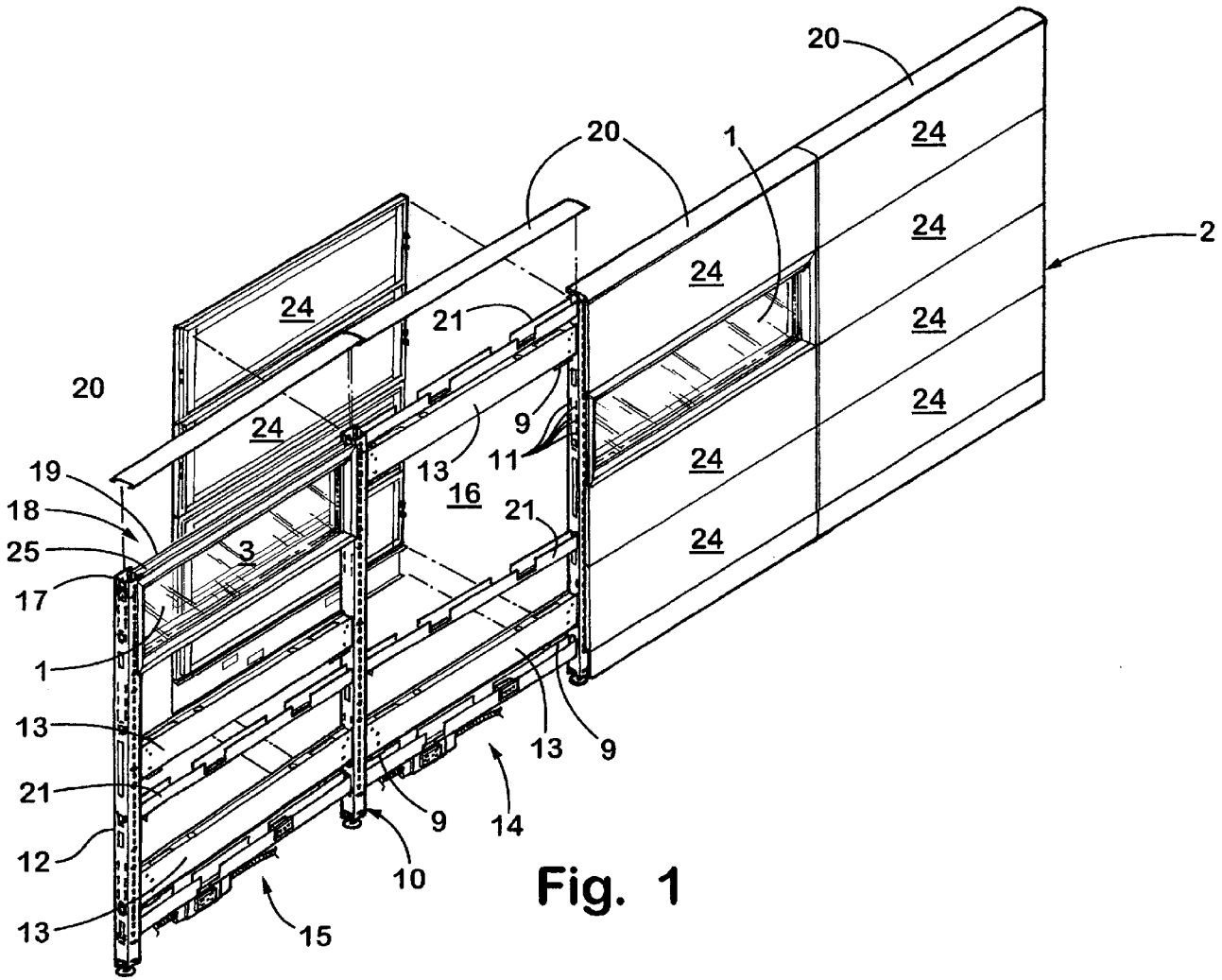
FIG. 1 is a partially exploded, perspective view illustrating a knockdown partition frame and fastenerless window embodying the present invention.

For purposes of description herein, terms "upper", "lower", "right", "left", "rear", "front", "vertical", "horizontal", and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a fastenerless window assembly embodying the present invention, which is particularly designed for use with a knockdown partition system 2. In the illustrated example, the fastenerless window assembly 1 includes a sheet 3 (see also FIG. 2) of light-transmitting material, such as glass, defining opposite side edges 4. Side members 5 may include side brackets 6 and support members 7. A pair of side members 5 is disposed on opposite side edges 4 of the glass sheet 3, and telescope relative to one another. At least a first one of the side members 5 includes a connector such as a hook 8 that secures the fastenerless window assembly 1 to a partition frame 10 of the knockdown partition system 2. The hook 8 engages apertures 11 of the frame 10 upon telescoping of the side members 5 to secure the window assembly 1 to the partition frame 10.

As described in detail in the above-identified co-pending U.S. application Ser. No. 09/060,913, now issued U.S. Pat. No. 6,098,358, knockdown partition frame 10 includes vertical posts 12 with horizontal beams 13 extending between the posts 12 and rigidly interconnecting the posts to form the partition frame 10. The horizontal beams 13 include quick-disconnectors such as movable lock members or wedges 9 movably mounted at opposite ends of each beam 13. The lock members 9 permit quick and easy assembly and disassembly of the knock-down partition frame 10 at the installation site. This arrangement permits the partition system 2 to be shipped in a disassembled condition, thereby reducing shipping costs and related expenses. Furthermore, very long beams 13 and cover panels 24, such as six feet, can be utilized. This permits further cost reduction by lowering the number of vertical posts 12 or other vertical frame members required along a particular partition wall. Still further, the longer panels reduce labor during assembly because the number of individual frame sections required is also reduced. The beams 13 are vertically spaced-apart, and form an enlarged opening 16 through the partition frame 10 of a first frame section 14. Alternately, the upper beam 13 may be spaced downwardly from the upper ends 17 of posts 12, thereby forming a generally U-shaped opening 18 through a second frame section 15 of partition frame 10. The window assembly 1 may be mounted above the upper beam 13 in the frame section 15, thereby forming an upper edge 19 of the partition system 2. As described in the above-identified patent application Ser. No. 09/060,913, now issued U.S. Pat. No. 6,098,358, top caps 20 of partition system 2 may be installed to a utility trough 21 positioned along the upper edge 19 of partition system 2. As described in more detail below, the window assembly 1 of the present invention includes horizontal channel members 25 having a cross-sectional shape with edge portions thereof that are substantially the same as the corresponding portions of the utility troughs 21, such that a top cap 20 may be installed directly to the horizontal channel member 25 of window assembly 1 when a window assembly 1 is installed in an upper position, such as the second frame section 15.

Figure 2:
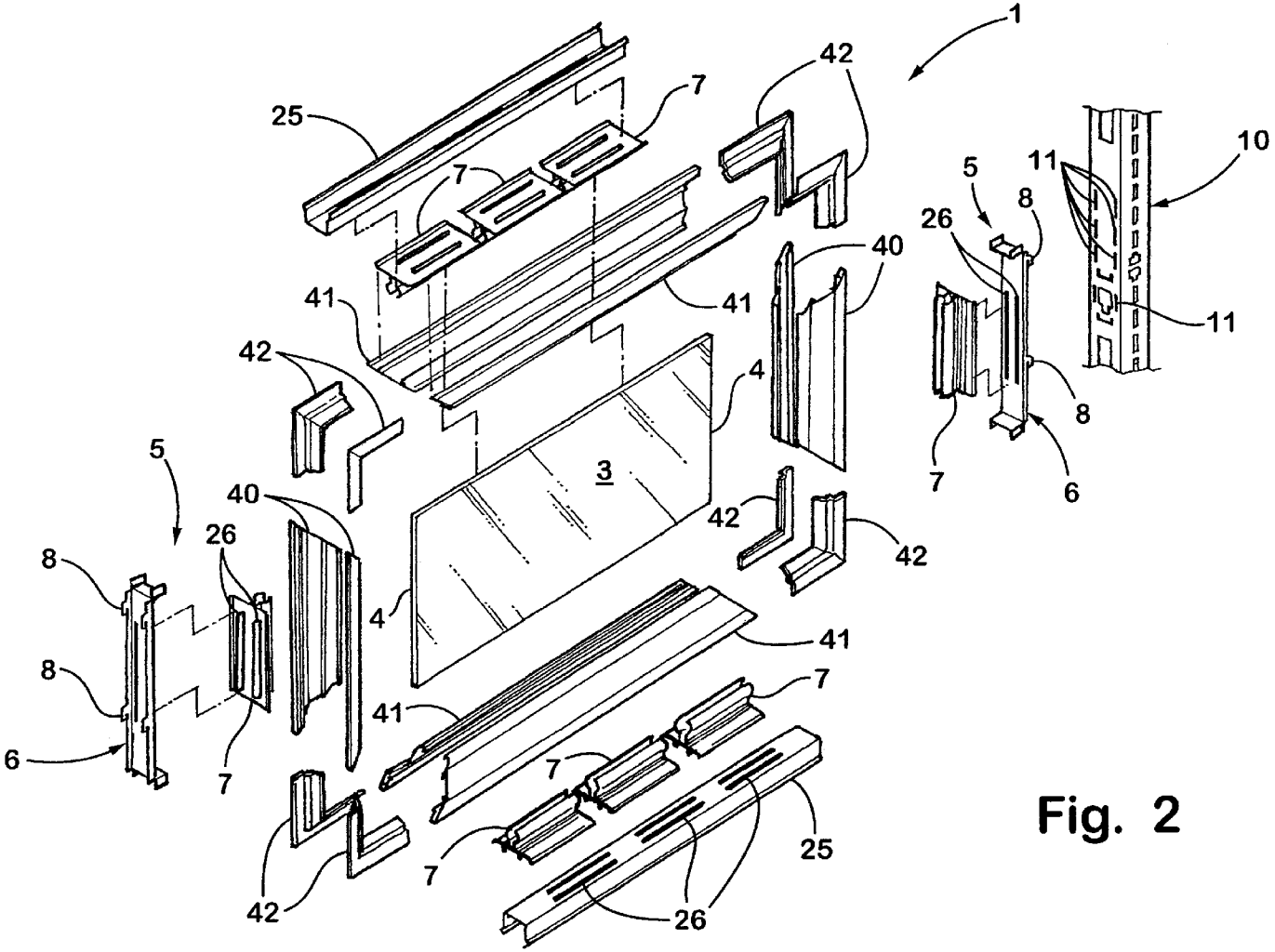
FIG. 2 is a partially fragmentary, perspective view of the fastenerless window assembly.

With reference to FIG. 2, window assembly 1 includes a plurality of support members 7 that are connected to the side brackets 6 and horizontal channel members 25. Side brackets 6 and channel members 25 may be of various lengths to form a desired size window assembly 1, such that additional or fewer apertures or slots 26 may be provided. Channels 25 and side brackets 6 are formed from sheet metal or other suitable material. The required number of support members 7 is selected and installed into slots 26 of side brackets 6 and channel members 25 according to the length of bracket 6 and channel member 25. This arrangement permits a single length support member 7 to be used for any of the window sizes, without requiring fabrication, storage, and handling of specially-sized support members 7 for each window size. As described in more detail below, vertical trim pieces 40 and horizontal pieces 41 are interconnected by L-shaped comer pieces 42, and installed to the window assembly after installation in the partition frame 10.

Figure 4:
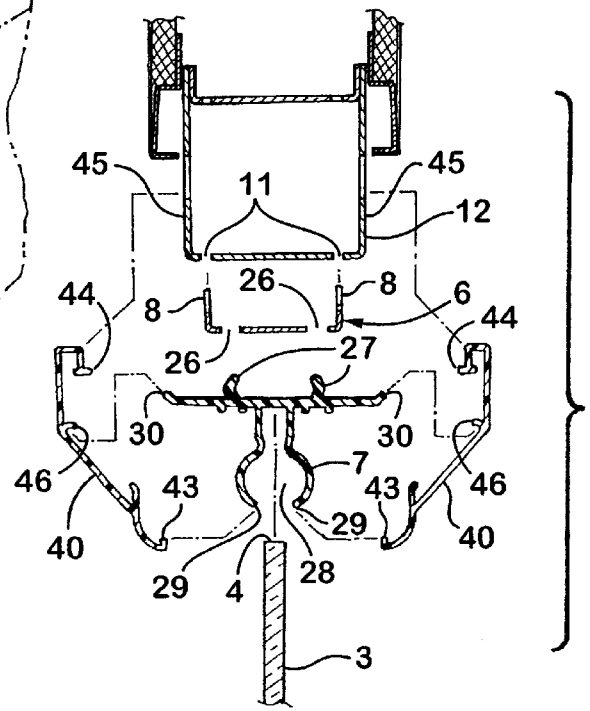
FIG. 4 is a fragmentary, cross-sectional view taken along the line IV–V.
Figure 3:
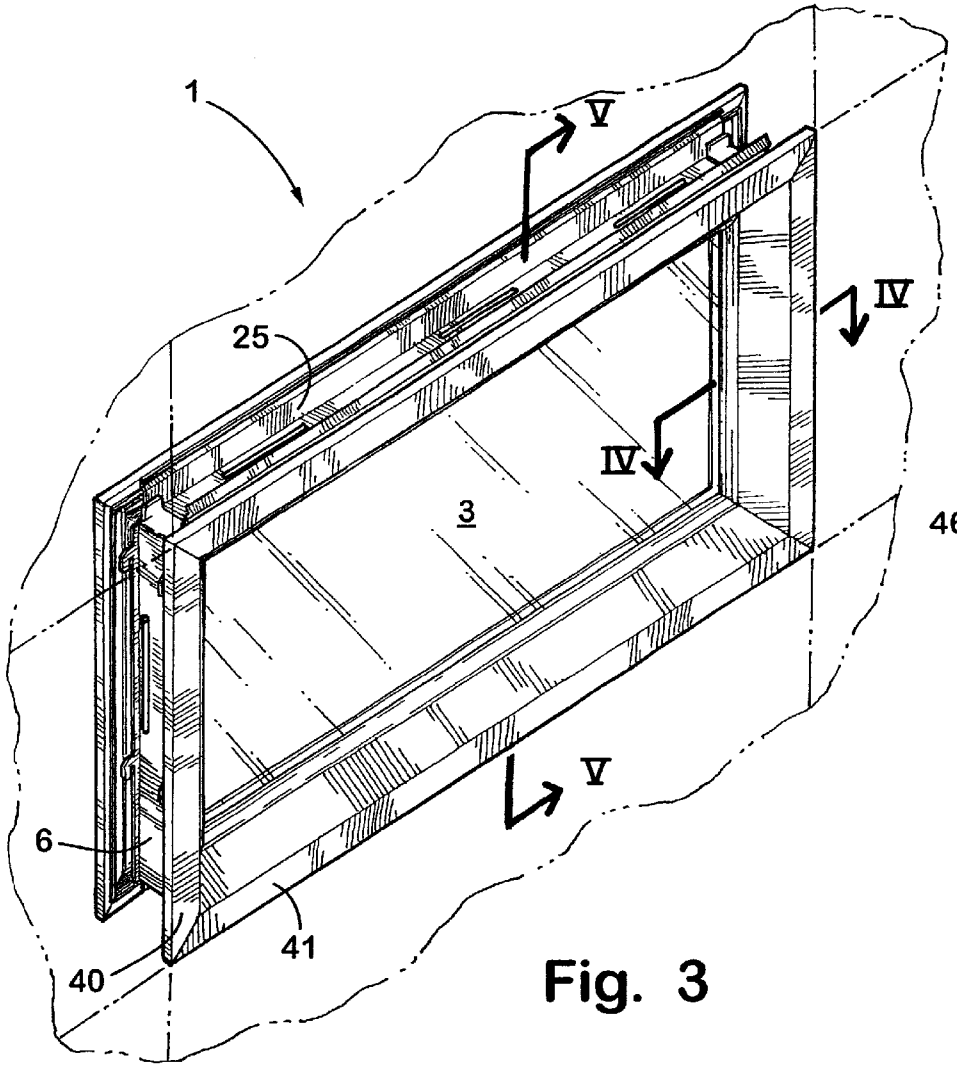
FIG. 3 is a perspective view of an assembled fastenerless window assembly of the present invention.

With reference to FIGS. 3 and 4, support members 7 are made of a polymer material such as rigid polyvinyl chloride ("PVC"), and include V-shaped flexible extensions 27 that snap into apertures 26 of side bracket 6 to form side members 5. Support members 7 include a channel 28 that receives the side edge 4 of glass sheet 3. Each trim piece 40 includes a hook-like edge portion 43 that engages the edge 29 of support members 7. Each trim member 40 also includes a second hook-like portion 46 that engages a second edge 30 of a support member 7 to retain the trim pieces 40 on the support members 7. Trim pieces 40 are made of a polymer material such as PVC having sufficient flexibility to permit flexing of the trim upon assembly. Edges 44 of trim pieces 40 abut the opposite faces 45 of post 12 to provide a finished appearance. As described in more detail below, the width of glass sheet 3 is sufficiently small to allow horizontal shifting of side brackets 6 and support members 7 during installation of the window assembly 1 in opening 16 of partition frame 10.

Figure 6:
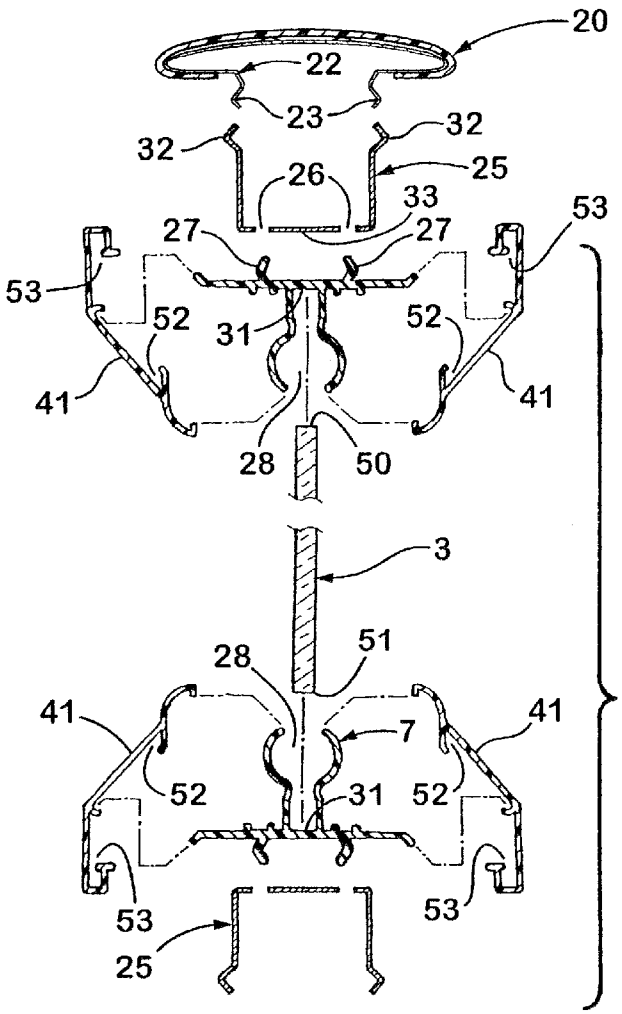
FIG. 6 is a partially fragmentary, exploded view of the assembly of FIG. 5.
Figure 5:
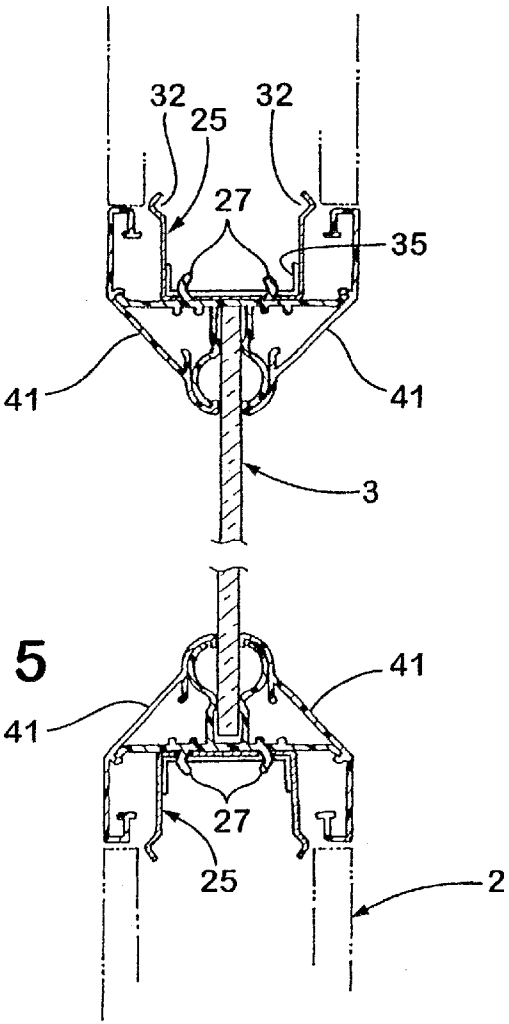
FIG. 5 is a partially fragmentary, cross-sectional taken along the line V—V.

With further reference to FIGS. 5 and 6, support members 7 are connected to the horizontal channel members 25 by flexible extension 27 that are received in apertures 26 of the channel members 25. Horizontal trim pieces 41 are made of the same material and have the same cross-sectional shape as vertical trim pieces 40. Trim pieces 41 and are installed to the support members 7 in the same manner as described above with respect to the vertical trim pieces 40. As described in more detail below, upper edge 50 and lower edge 51 of glass sheet 3 abut the bottom wall 31 of channel 28 when assembled (FIG. 5), such that window assembly 1 will have the correct overall vertical size to fit closely within opening 16 of partition frame 10. The gravitational forces acting on the window components, as well as friction between the components, tend to maintain the engagement of the upper and lower edges 50 and 51, respectively, against the bottom walls 31 of supports 7 when the window assembly 1 is in the installed position. Each horizontal channel member 25 has a generally U-shaped cross-section with V-shaped edge portions 32. Top cap 20 includes a spring clip 22 having V-shaped end portions 23 that resiliently engage edge 32 of channel 25 when window assembly 1 is in an upper position as illustrated in second frame section 15 of FIG. 1. The V-shaped edges 32 of horizontal channel members 25 have substantially the same shape as the upper edges of cover panels 24, such that a standard top cap 20 may be interconnected with either a horizontal channel member 25 of window assembly 1, or to the upper edges of covers 24.

Figure 8:
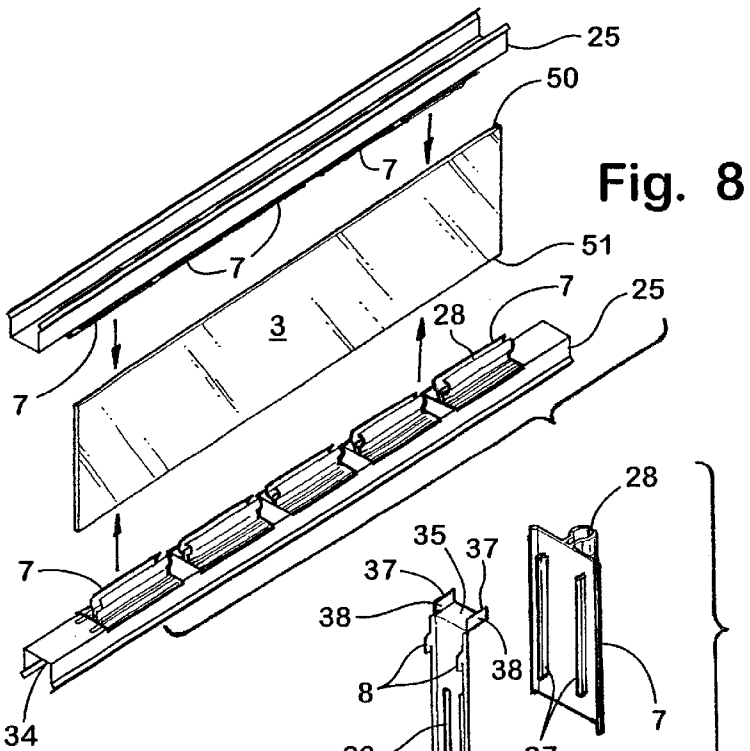
FIG. 8 is an exploded perspective view illustrating assembly of the upper and lower channels and support members to the glass sheet.
Figure 7:
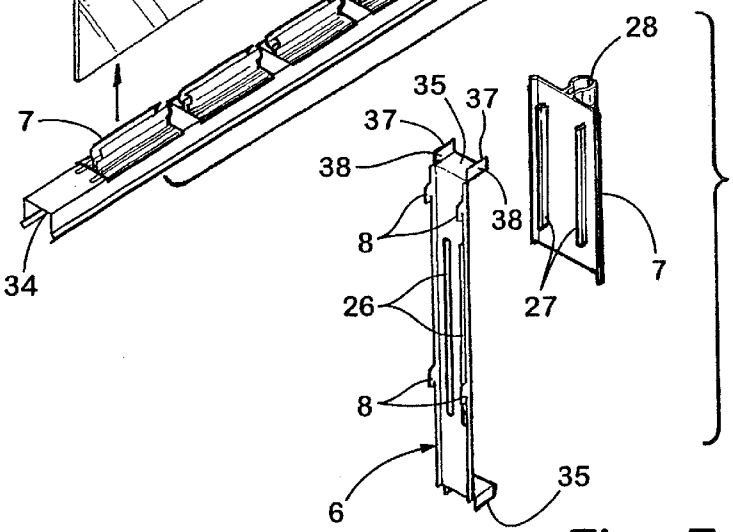
FIG. 7 is an exploded perspective view illustrating a side bracket and a support member.

With further reference to FIG. 7, during assembly the required number of support members 7 are snapped into the apertures 26 of side brackets 6 and horizontal channel members 25. With further reference to FIG. 8, the channel members 25 are then installed to the upper and lower edges 50 and 51, respectively of glass sheet 3. The upper and lower edges 50 and 51, respectively, are slidably received within the channels 28 of support members 7, and abut the bottom walls 31 of channels 28 due to the gravitational and frictional forces acting on the components.

Figure 9:
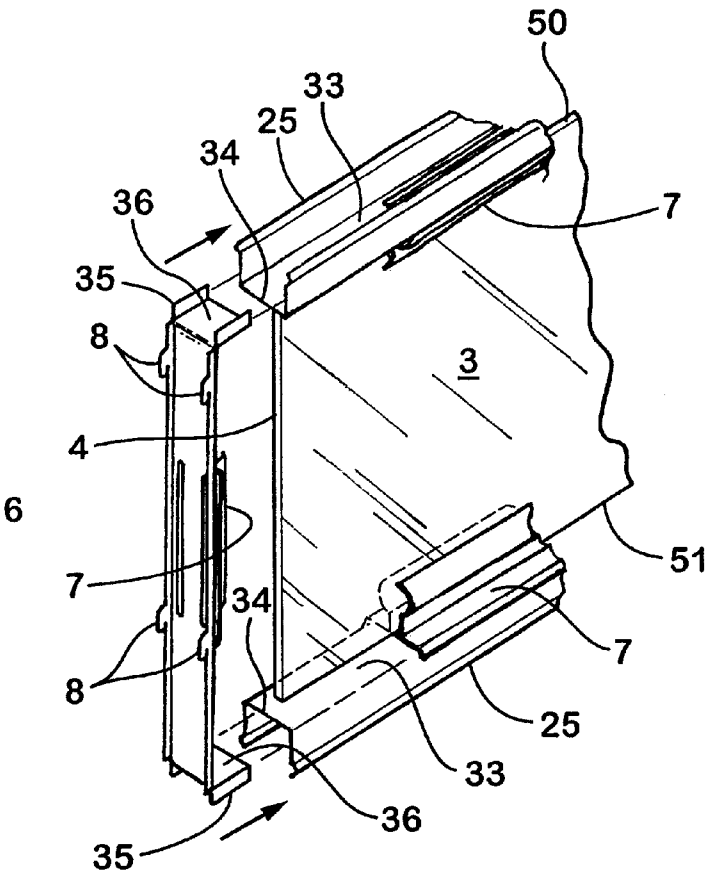
FIG. 9 is a fragmentary perspective view illustrating installation of the side brackets to the side edges of the glass sheet.
Figure 10:
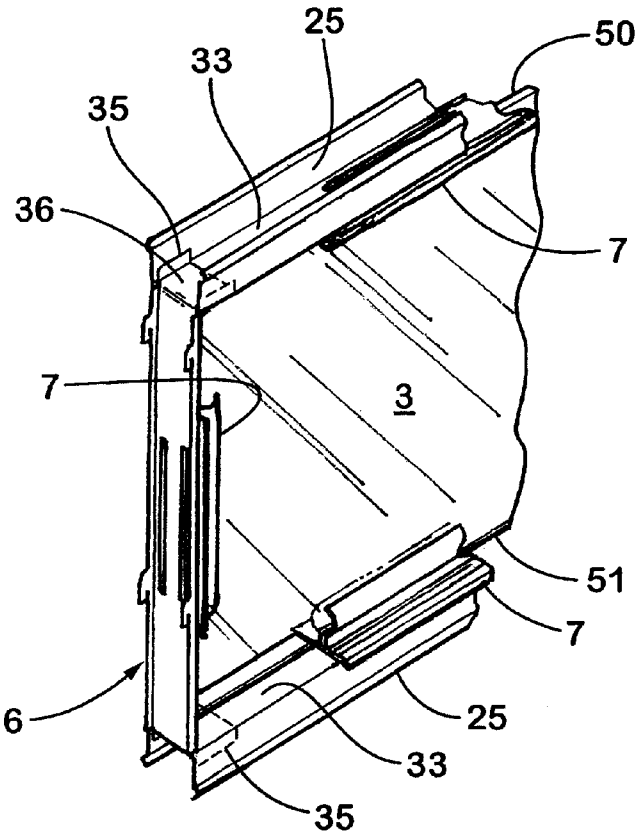
FIG. 10 is a fragmentary perspective view illustrating the side brackets in the installed position with the transverse end extensions slidably engaging the upper and lower channels.
Figure 12:
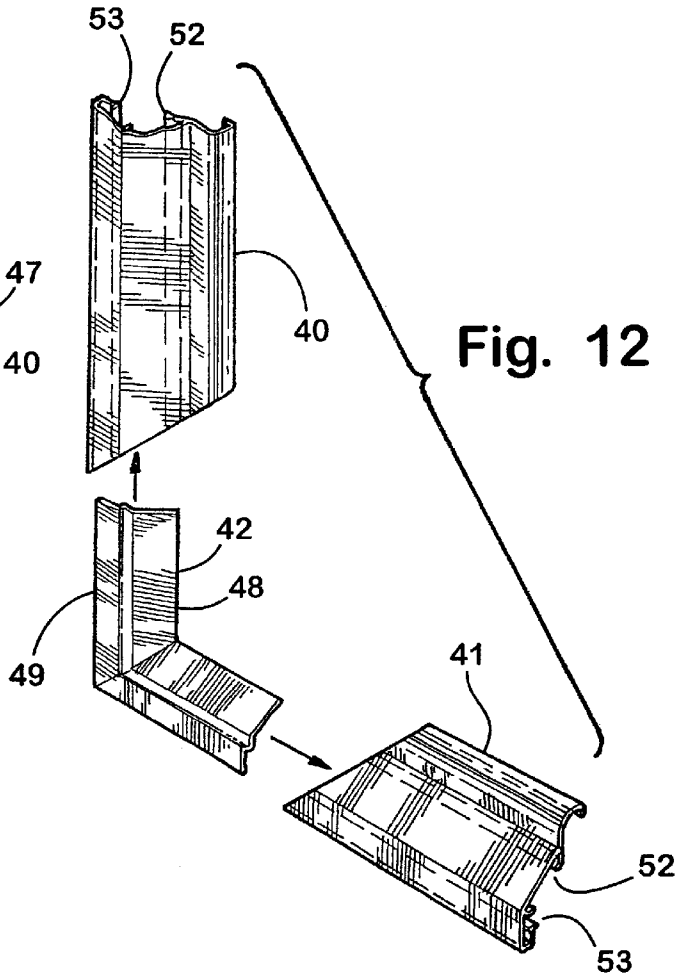
FIG. 12 is a fragmentary perspective view illustrating assembly of the window trim.

With further reference to FIGS. 9 and 10, side brackets 6 with side members 5 are then installed to the side edges 4 of glass sheet 3. Each bracket member 6 includes a transverse extension 35 having a generally U-shaped cross-section that fits closely within the horizontal channel member 25 (see also FIG. 5). The base wall 36 of extension 35 fits snugly, yet slidably against base wall 33 of channel 25 when installed. The transverse extensions 35 of bracket 6 retain the channel members 25 to the upper and lower side edges 50 and 51, respectively of glass sheet 3 as illustrated in FIG. 10. As discussed above, the channel 28 of supports 7 have sufficient depth to permit horizontal shifting of side brackets 6 without entirely removing the opposite side edges 4 from the channels 28. In addition, the transverse extensions 35 also have sufficient length to retain sliding, telescopic engagement with channel 25 over a horizontal range of motion of side brackets 6.

Figure 11:
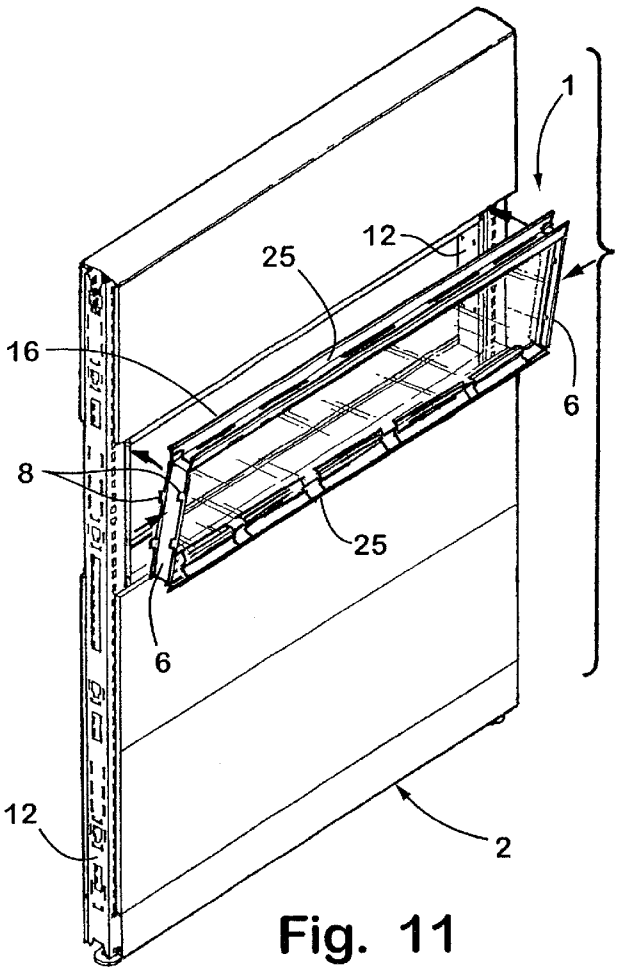
FIG. 11 is a perspective view illustrating installation of the window assembly into the partition frame.
Figure 13:
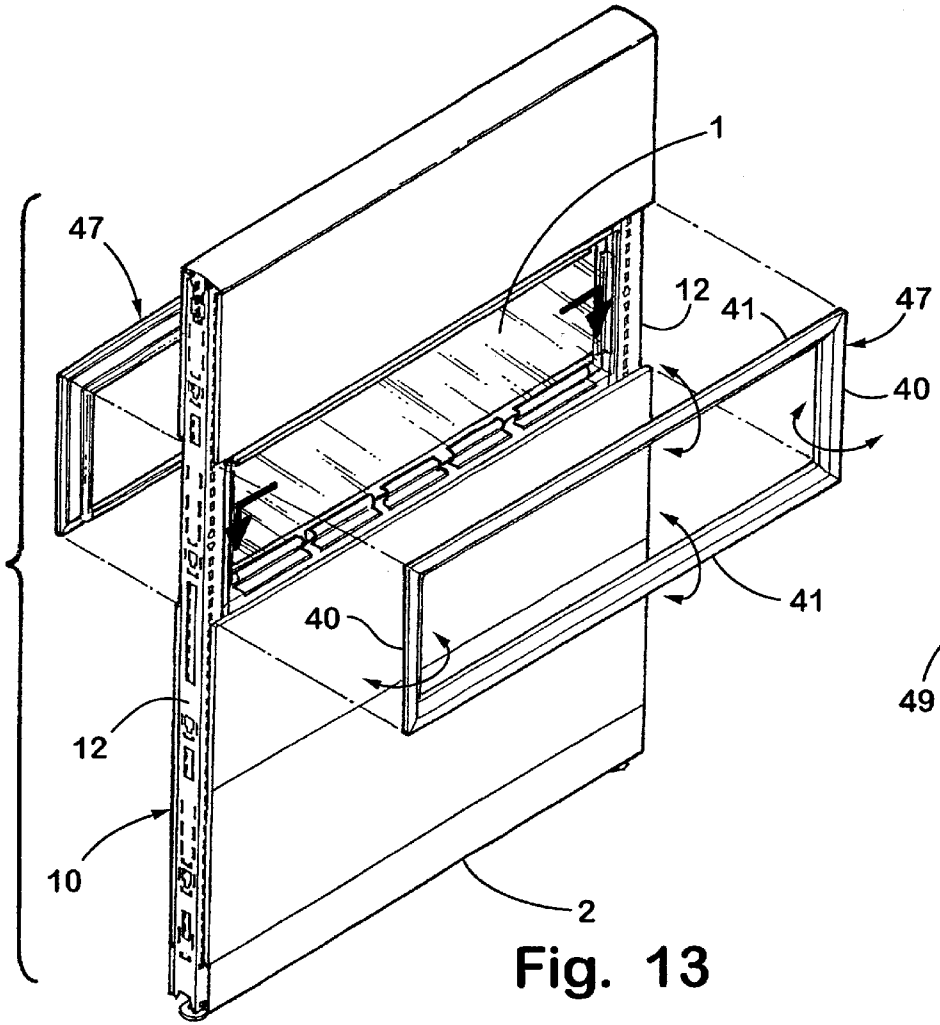
FIG. 13 is a fragmentary perspective view illustrating installation of the trim to the window assembly.

With further reference to FIG. 11, during installation of window assembly 1 to the partition system 2, the installer manually grasps side brackets 6 and shifts brackets 6 inwardly, such that hooks 8 will fit between the spaced-apart upright posts 12 forming the sides of opening 16. With further reference to FIG. 13, the window assembly 1 is then manually shifted into the opening 16, between the posts 12. The side brackets 6 are then shifted outwardly, such that hooks 8 are inserted into the apertures 11 in post 12. The window assembly 1 is then shifted downward to engage hooks 8 with apertures 11. When in the installed position, window assembly 1 is maintained in the assembled condition by the engagement of the side brackets 6 with posts 12, and the engagement of extensions 35 in the horizontal channels 25.

After installation of the window assembly 1 in the partition frame 10, a trim assembly 47 is formed by snapping the vertical and horizontal trim pieces 40 and 41, respectively, onto L-shaped corner piece 42. L-shaped comer piece 42 is made of a suitable polymer material, such as ABS terpolymer. The first and second side edges 48 and 49 of L-shaped corner piece 42 engage the first and second hook portion 52 and 53 (see also FIG. 6) of trim pieces 40 and 41, and thereby interconnect the trim pieces 40 and 41 to form the trim assembly 47. During installation, the trim assembly 47 is flexed, and the first hook 43 (FIG. 4) is flipped over the first edge 29 of the support members 7. The second hook portion 46 is then snapped over the second edge 30 of support members 7. The trim pieces 40, 41, and 42 have sufficient flexibility to permit flexation and installation of the trim assembly 47 as a unit in the manner described above.

Figure 14:
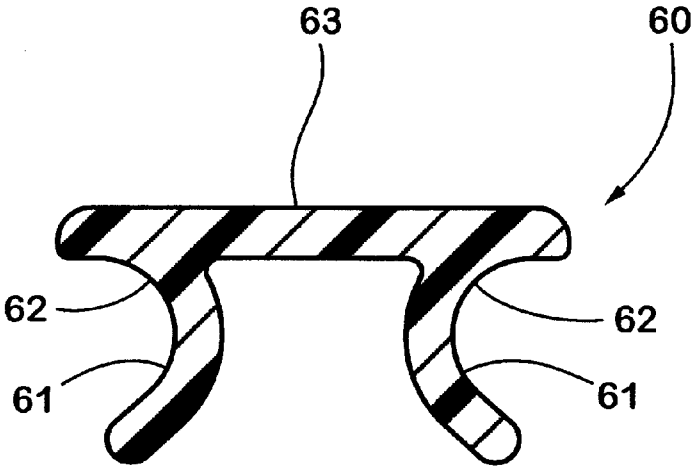
FIG. 14 is a cross-sectional view of a trim member used with a pass-through version of the module.

With reference to FIG. 14, a trim piece 60 made of a polymer material such as "PVC" can be snapped into the channels 28 of supports 7 instead of a glass sheet 3, thereby forming a pass-through module. Trim piece 60 includes a pair of downwardly extending leg portions 61, each of which has a radiused outer surface 62. The radiused outer surface 62 engages the edge 29 of support member 7, such that the upper wall 63 of trim piece 60 closes off the channel 28. Four of the trim pieces 60 are used to form a pass-through module, with one trim piece 60 secured to the supports 7 on each of the horizontal channels 25, and a trim piece 60 also fits onto the support members 7 of each side bracket 6. The ends of each trim piece 60 are entered as required to form a smooth corner.

Figure 15:
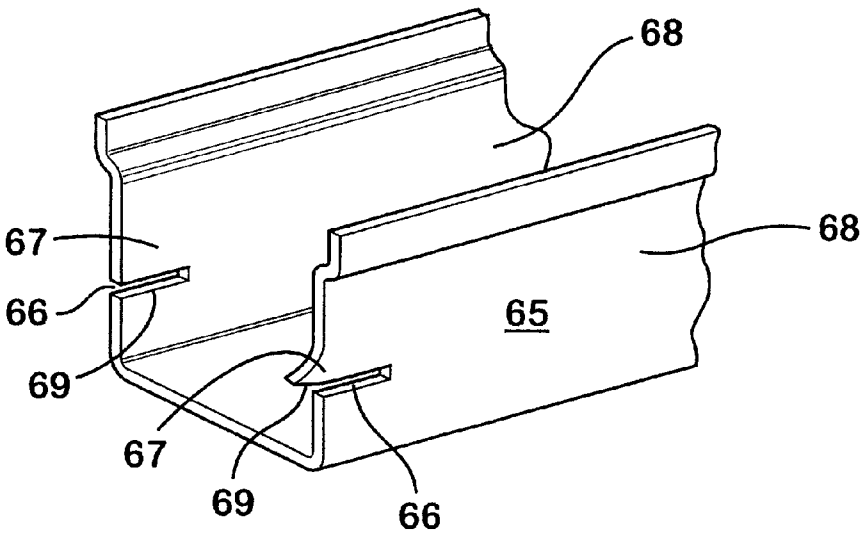
FIG. 15 is a fragmentary, perspective view of the end of a horizontal channel member that can be used to form either a window assembly or a pass-through module.

With further reference to FIG. 15, a modified horizontal channel member 65 has substantially the same cross-sectional shape as the horizontal channel member 25 described above. However, the modified horizontal channel member 65 which includes a pair of cut-out slots 66. The portions 67 of sidewalls 68 above slots 66 are bent inwardly, such that the lower edge 69 engages the upper edge 37 (see also FIG. 7) of the sidewalls 38 of the extensions 35 of side brackets 6. Channel 65 slidably engages the extensions 35 of side brackets 6, and the engagement between the extension 35 and the bent-out portion 67 supports the channels 65 in the proper vertically-spaced relationship.

The pass-through module is installed in a substantially similar manner as the glass module described above. Support members 7 are first connected to the horizontal members 65, and to end brackets 6. The extensions 35 of side brackets 6 are then engaged with the cut-out slots 66 of the horizontal members 65, and the resulting frame assembly is then inserted into the opening 16. The side brackets 6 are then shifted outwardly to engage the hooks 8 in the openings 11 of posts 12 in the same manner as described above for the window assembly. The trim pieces are then installed, and the trim piece 60 is snapped into the channel 28 to finish the pass-through module. The horizontal channel 65 can also be used with the glass sheet 3 described above to form a window assembly, such that the same side brackets 6 and horizontal channel members 65 can be used to form either a pass-through module or a glass module. This arrangement reduces the number of parts and associated costs. When used to form the glass window assembly described above, the horizontal channel member 65 functions in substantially the same manner as the channel member 25 described above, except that the cut-out slots 66 engage the transverse extensions 35 and thereby maintain the proper vertical spacing of the horizontal channels 65. The assembly of the window 1 is otherwise substantially the same as described above. Sheet 3 has been described as light-transmitting. It is anticipated that sheet 3 could also be made of opaque material to provide privacy if required for a particular application. In particular, sheet 3 could be made of a hardboard, or an opaque polymer material, and could include a decorative surface, and a sound absorbing and/or isolating core. Furthermore, sheet 3 could be made of a translucent material, or could be made of a substantially clear material having a frosted or other surface treatment.

The fastenerless window assembly 1 of the present invention can be quickly and easily assembled and installed on-site. Furthermore, the window assembly may also be quickly and easily disassembled on-site if partition system 2 is reconfigured. The knock-down assembly permits shipping in a disassembled condition, thereby reducing storage and shipping costs.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A combination partition frame and window assembly, comprising:

a freestanding partition frame adapted to be abuttingly supported on a floor surface in an upright manner, said partition frame defining an enlarged opening through said partition frame; and a window assembly including a sheet of light-transmitting material defining opposite side edges, and side members disposed on said opposite side edges and defining a distance therebetween, said side members telescoping horizontally relative to one another and changing said distance, at least a first one of said side members including a connector for securing said window assembly to said partition frame, said connector engaging said partition frame upon telescoping of said side members to secure said window assembly to said partition frame in said enlarged opening.

2. A window assembly for installation across at least a portion of an opening through a partition frame, said window assembly comprising:

a sheet of light-transmitting material defining opposite side edges;

side members disposed on said opposite side edges and defining a distance therebetween, said side members telescoping horizontally relative to one another and changing said distance, at least a first one of said side members including a connector for securing said window assembly to said partition frame;

said connector adapted to engage said partition frame upon telescoping of said side members to secure said window assembly to said partition frame; and wherein said side members include a channel slidably receiving an edge portion of said sheet.

3. A combination partition frame and window assembly for installation across at least a portion of an opening through a partition frame, said window assembly comprising:

a freestanding partition frame adapted to be abuttingly supported on a floor surface in an upright manner, said partition frame defining an enlarged opening through said partition frame; and a window assembly including a sheet of light-transmitting material defining opposite side edges, and side members disposed on said opposite side edges and telescoping relative to one another, at least a first one of said side members including a connector securing said window assembly in said enlarged opening of said partition frame, said connector adapted to engage said partition frame upon telescoping of said side members to secure said window assembly to said partition frame, said window assembly further including upper and lower members disposed along upper and lower edges of said sheet; and wherein said side members engage said upper and lower members.

4. A partition frame comprising:

a freestanding partition frame adapted to be abuttingly supported on a floor surface in an upright manner, said partition frame defining an enlarged opening through said partition frame; and said partition frame including a window assembly having a sheet of light-transmitting material defining opposite side edges, and side members disposed on said opposite side edges and telescoping relative to one another, at least a first one of said side members including a connector securing said window assembly in said enlarged opening said partition frame, said connector engaging said partition frame upon telescoping of said side members to secure said window assembly to said partition frame, said window assembly further including upper and lower members disposed along upper and lower edges of said sheet, said side members slidably engaging said upper and lower members to provide telescoping movement of said side members, and wherein said side members are elongated with transverse extensions proximate opposite ends thereof, said extensions slidably engaging said upper and lower members.

5. The partition frame of claim 4, wherein:

said sheet has a horizontal dimension permitting said side members to be shifted inwardly on said side edges of said sheet to a position permitting insertion of said window assembly between a pair of vertical frame members that form side edges of the opening in the partition frame.

6. A window assembly for installation across at least a portion of an opening through a partition frame, said window assembly comprising:

a sheet of light-transmitting material defining opposite side edges;

elongated side members disposed on said opposite side edges and telescoping relative to one another, at least a first one of said side members including a connector for securing said window assembly to said partition frame; said connector adapted to engage said partition frame upon telescoping of said side members to secure said window assembly to said partition frame, said window assembly including:

upper and lower members disposed along upper and lower edges of said sheet; said side members slidably engaging said upper and lower members for telescoping movement of said side members; said side members having transverse extensions proximate opposite ends thereof slidably engaging said upper and lower members;

said sheet having a horizontal dimension permitting said side members to be shifted inwardly on said side edges of said sheet to a position permitting insertion of said window assembly between a pair of vertical frame members that form side edges of the opening in the partition frame; and wherein each side member includes at least one hook on an outer side adapted for engagement with an aperture in a vertical frame member.

7. The window assembly of claim 6, wherein:

said upper and lower members each include a channel defining a base surface and receiving an edge portion of said sheet;

said sheet having a vertical dimension corresponding to the opening in the partition frame, such that said upper and lower members fit closely within the opening when the edge portions of the sheet abut said base surfaces of said channels.

8. The window assembly of claim 7, wherein:

said side members include an elongated side bracket having at least one aperture therethrough; and said side members further including a support member having a resilient extension receivable in said aperture to retain said support member to said side bracket.

9. The window assembly of claim 8, wherein:

said upper and lower members include an elongated channel member having a U-shaped cross section defining a pair of side webs and a base web having at least one aperture therethrough;

said upper and lower members further including a support member having a resilient extension receivable within said aperture; and said transverse extensions of said side members received within opposite ends of said elongated channel members.

10. A combination knockdown partition frame and window assembly, comprising:

a pair of horizontally spaced-apart vertical posts;

a pair of vertically spaced-apart horizontal beams extending therebetween and having opposite ends releasably interconnecting said posts to define therewith a free-standing partial height partition frame having an enlarged opening therethrough when assembled;

a light-transmitting sheet;

a pair of edge members movably positioned on opposite edges of said sheet for movement relative to one another between an engaged position defining a first distance between said edge members, and a disengaged position defining a second distance between said edge members that is different than said first distance; and at least a first one of said edge members including a connector that engages said partition frame upon movement to said engaged position to thereby connect said window assembly to said partition frame when said light-transmitting sheet is positioned across said enlarged opening such that said light-transmitting sheet and said edge members can be positioned in said enlarged opening as a unit and secured to said partition frame upon shifting of said edge members to said engaged position.

11. The combination knockdown partition frame and window assembly of claim 10, wherein:

said opening is generally quadrilateral and defines a cross dimension between opposite sides thereof;

said edge members define a channel slidably receiving opposite edges of said sheet, said channel defining a base and a pair of sides; and said sheet having a dimension permitting insertion of said window assembly within said opening in said partition frame when said side edges are received within said channels, said channels defining a depth sufficient to retain said sheet upon shifting of said edge member to said engaged position.

12. The combination knockdown partition frame and window assembly of claim 10, wherein:

said posts each define an upper end;

said horizontal beams comprise upper and lower beams, said upper beam spaced downwardly from said upper ends of said posts, said opening through said partition frame formed above said upper beam, said window assembly positioned above said upper beam, said window assembly defining an upper edge positioned proximate said upper ends of said posts.

13. A combination knockdown partition frame and window assembly, comprising:

a pair of horizontally spaced-apart vertical posts;

a pair of vertically spaced-apart horizontal beams extending therebetween and having opposite ends releasably interconnecting said posts to define therewith a partition frame having an enlarged opening therethrough;

a light-transmitting sheet;

a pair of edge members positioned on opposite edges of said sheet and movable relative to one another between an engaged position and a disengaged position;

at least a first one of said edge members including a connector that engages said partition frame upon movement to said engaged position to thereby connect said window assembly to said partition frame;

said opening is generally quadrilateral and defines a cross dimension between opposite sides thereof;

said edge members define a channel slidably receiving opposite edges of said sheet, said channel defining a base and a pair of sides;

said sheet having a dimension permitting insertion of said window assembly within said opening in said partition frame when said side edges are received within said channels, said channels defining a depth sufficient to retain said sheet upon shifting of said edge member to said engaged position, including:

elongated upper and lower edge members disposed along upper and lower edges of said sheet; and wherein:

said edge members comprise elongated side brackets having transverse extensions proximate opposite ends thereof;

said extensions telescopingly engaging opposite ends of said upper and lower edge members.

14. The combination knockdown partition frame and window assembly of claim 13, wherein:

said opening in said frame defines a vertical dimension between said beams;

said upper and lower edge members include a channel defining a base and a pair of side walls, said channels receiving upper and lower edges of said sheet; and said sheet having a vertical dimension corresponding to said vertical dimension of said frame opening such that said window assembly has a vertical dimension providing a close fit between said beams when said upper and lower edges of said sheet abut said bases of said channels.

15. The combination knockdown partition frame and window assembly of claim 14, wherein:

said posts each have an inner face defining a side edge of said opening through said partition frame;

each inner face having at least one aperture receiving said connector of said edge members.

16. The combination knockdown partition frame and window assembly of claim 15, wherein:

said side brackets each includes at least one hook received within said apertures in said posts when said window assembly is installed.

17. The combination knockdown partition frame and window assembly of claim 16, wherein:

said upper and lower edge members have a U-shaped cross sectional shape with open opposite ends; and said transverse extensions are slidably received within said open ends and retaining said upper and lower edge members to said sheet when said side brackets engaged with said upper and lower edge members.

18. The combination knockdown partition frame and window assembly of claim 13, wherein:

said side brackets shift outwardly from said upper and lower edge members to define a gap therebetween when said window assembly is installed to said partition frame; and including at least one trim member secured to said window assembly and covering said gap to form a continuous outer surface.

19. The combination knockdown partition frame and window assembly of claim 18 wherein:

each said edge member includes a channel receiving a side edge of said sheet, each channel having a base wall and a pair of side walls terminating in a free edge directly adjacent said sheet; and including a quadrilateral trim assembly having a lip extending around an inner edge thereof, said trim assembly formed of a flexible material permitting insertion of said lip between said free edge of said side walls and said sheet during assembly of said trim assembly to said window assembly.

20. A method of securing a window assembly to a partial height partition frame, comprising:

providing a space having a floor and a ceiling;

providing a freestanding partial height partition frame in a space having a horizontal upper edge spaced downwardly from the ceiling to form a gap;

providing a light-transmitting sheet having opposite side edges;

placing at least one side member on a selected one of said side edges of said sheet in a movable relationship thereto to form a window assembly;

placing said light-transmitting sheet across at least a portion of an opening through said frame;

shifting said side member relative to said sheet into engagement with said frame to thereby interconnect said side members and said frame.

21. A method of securing a window assembly to a partial height partition frame, comprising:

providing a space having a floor and a ceiling;

providing a freestanding partial height partition frame in a space having a horizontal upper edge spaced downwardly from the ceiling to form a gap;

providing a light-transmitting sheet having opposite vertical side edges;

placing at least one side member on a selected one of said side edges of said sheet in a movable relationship thereto to form a window assembly;

placing said light-transmitting sheet across at least a portion of an opening through said frame;

shifting said side member relative to said sheet into engagement with said frame to thereby interconnect said side members and said frame;

placing vertical side members on opposite vertical side edges of the sheet;

placing horizontal upper and lower side members on upper and lower edges of the sheet to form a window assembly;

shifting said vertical side members inwardly towards one another on said side edges of said sheet;

placing said window assembly within an opening through a partition frame;

shifting said vertical side members outwardly to secure said window assembly within said partition frame.

22. A method of securing a window assembly to a frame, comprising:

providing a light-transmitting sheet having opposite side edges;

placing at least one side member on a selected one of said side edges of said sheet in a movable relationship thereto to form a window assembly;

placing said light-transmitting sheet across at least a portion of an opening through said frame;

shifting said side member relative to said sheet into engagement with said frame to thereby interconnect said side members and said frame said side edges comprise vertical side edges; and including;

placing vertical side members on opposite side edges of the sheet;

placing horizontal upper and lower side members on upper and lower edges of the sheet to form a window assembly;

shifting said vertical side members inwardly towards one another on said side edges of said sheet;

placing said window assembly within an opening through a partition frame;

shifting said vertical side members outwardly to secure said window assembly within said partition frame, wherein:

said frame includes apertures adjacent the opening through the frame; and said vertical side members include hooked connectors that are received within said apertures when said vertical side members are shifted outwardly.

23. The method of claim 22, including:

providing a flexible quadrilateral trim assembly having a lip extending around an inner edge thereof;

flexing said trim assembly to engage said lip with at least a selected one of said side members to secure said trim assembly to said window assembly.

24. The method of claim 23, wherein:

each side member includes a support having a channel on a first side for receiving an edge of said sheet, and a connector on an opposite side; and each side member assembled by securing said connector to an elongated channel member prior to placing said side members on said sheet.

25. A module for installation within an opening in a partition frame, said module including:

a pair of vertically spaced-apart horizontal frame members, a pair of horizontally spaced-apart side frame members, said side frame members telescopically engaging said horizontal frame members and shifting between engaged and disengaged positions; and said side frame members including at least one connector adapted to engage a partition frame when said side frame member is shifted to said engaged position to retain said frame to said partition frame.

26. The module of claim 25, wherein:

said horizontal frame members and said side frame members each define an inwardly-facing channel capable of receiving a side edge of a light-transmitting sheet therein, and including:

an elongated trim member having an extension receivable within said channel and shaped to retain said trim member therein to form a pass-through module.

27. The module of claim 26, wherein:

said side frame members each include a pair of extensions telescopically engaging said horizontal frame members adjacent opposite ends thereof.

28. A partition frame, comprising:

a freestanding partition frame adapted to be abuttingly supported on a floor surface in an upright manner, said partition frame defining an enlarged opening through said partition frame; and a window module including a translucent sheet defining an upper edge and a support assembly adapted to support said translucent sheet on a partition frame, said support assembly including a horizontal member extending adjacent said upper edge of said translucent sheet, said horizontal member having a U-shaped cross section forming an opening, wherein said support assembly includes first and second horizontally spaced-apart vertical side members, at least one of which telescopically engages said horizontal member.

29. A partition frame, comprising:

a pair of horizonally spaced-apart upright posts, each defining an upper end;

at least one horizontal beam extending between said posts and rigidly interconnecting the same, said beam spaced below said upper ends of said posts to form a rigid partition frame having an opening with an enlarged, generally U-shape through said partition frame above said horizontal beam, and an enlarged lower opening through said partition frame below said horizontal beam;

a cover panel attached to said partition frame and closing off at least a portion of said lower opening; and a window module positioned within said opening and extending between said posts, said window module having an upwardly-opening channel adjacent said upper ends of said posts and extending between said posts to form an upper edge of said partition frame.

30. The partition frame set forth in claim 29, wherein:

said window module includes a horizontal member having a U-shaped cross section that forms said upwardly-opening channel.

31. The partition frame set forth in claim 29, wherein:

said horizontal beam comprises an upper beam; and including:

a lower beam positioned below said upper beam and rigidly interconnecting said posts.

32. The partition frame set forth in claim 29, wherein:

said window module defines vertical side edges, each side edge having at least one connector securing said window module to said posts.

33. The partition frame set forth in claim 29, wherein:

a top cap closing off said channel.

34. The partition frame set forth in claim 29, wherein:

said posts have a plurality of beam connection ports on opposite side faces thereof, said beam rigidly connected to selected ones of said beam connection ports, and said window module supported by other ones of said beam connection ports.

* * * * *